United States Patent [19]

Okolischan

[11] 4,410,077

[45] Oct. 18, 1983

[54] COIN HANDLING APPARATUS WITH COIN RETARDATION FEATURE

[75] Inventor: Anton Okolischan, Crestwood, Mo.

[73] Assignee: UMC Industries, Inc., Stamford, Conn.

[21] Appl. No.: 268,749

[22] Filed: Jun. 1, 1981

[51] Int. Cl.[3] ..... G07F 1/04

[52] U.S. Cl. ..... 194/1 K; 133/3 D

[58] Field of Search ..... 194/102, 1 K, 101, 100 R, 194/DIG. 17; 133/3 C, 3 D, 3 R, 3 E, 3 A

[56] References Cited

U.S. PATENT DOCUMENTS

| | | | |
|---|---|---|---|
| 2,729,391 | 1/1956 | Straubel et al. | 194/1 K X |
| 3,197,009 | 7/1965 | Okolischan | 194/97 |
| 3,889,792 | 6/1975 | Willis | 194/1 K |
| 3,944,038 | 3/1976 | Zeggeren | 194/1 K |
| 4,175,989 | 11/1979 | Pospischil et al. | 194/1 K |

FOREIGN PATENT DOCUMENTS

| | | | |
|---|---|---|---|
| 2308776 | 8/1973 | Fed. Rep. of Germany | 194/1 K |

*Primary Examiner*—Stanley H. Tollberg

*Attorney, Agent, or Firm*—Senniger, Powers, Leavitt and Roedel

[57] ABSTRACT

Coin handling apparatus having an inclined chute and a lateral entrance to the chute, the arrangement being such that the motion of the coins is retarded or deadened for rolling of the coins on edge down the chute without substantial bounce or flutter for accurate detection by a detector at one side of the chute downstream from the entrance.

11 Claims, 10 Drawing Figures

COIN HANDLING APPARATUS WITH COIN RETARDATION FEATURE

BACKGROUND OF THE INVENTION

This invention relates to coin handling apparatus and more particularly to means for retarding or deadening the motion of coins travelling through such apparatus thereby to ensure that they are accurately sensed by sensing or detecting devices within the apparatus.

Coin handling apparatus used in vendors and the like typically include various detection devices, such as a device for detecting whether an item traveling through the apparatus is an acceptable coin or an unacceptable item (e.g., a slug or unacceptable coin) and, if it is an acceptable coin, detecting its denomination. A detection device of this type may be, for example, an electromagnetic detector or indicator such as shown in U.S. Pat. Nos. 3,918,564, 3,952,851 or 3,966,034. To ensure accurate detection by such a device, it is important that items move smoothly past the device without substantial bounce or flutter and at the same speed, regardless of coin size and mass.

Reference may be made to U.S. Pat. Nos. 3,889,792 and 3,944,038 which disclose devices for dissipating the kinetic energy of a coin as it travels through a coin handling mechanism.

SUMMARY OF THE INVENTION

Among the several objects of this invention may be noted the provision of improved coin handling apparatus of the class described above which is adapted for deadening the motion of an item (i.e., an acceptable coin or unacceptable item) to minimize bounce and flutter of the item as it travels through the apparatus thereby to ensure that it is accurately detected by detection devices in the apparatus; the provision of such apparatus which effects movement of items generally at the same speed past the detection devices despite variations in size and mass of the item; and the provision of such apparatus which is adapted to handle coins of different denominations having different diameters without unduly increasing the height of the apparatus.

In general, this invention involves an improvement in coin handling apparatus of the type having a track down which coins may roll on edge, walls at opposite sides of the track for confining the coins to rolling along the track, the track and walls forming a chute, the latter being inclined off vertical for coins to roll down the chute in face-to-face engagement with one of the walls, and means along said one wall of the chute for detecting a coin as it rolls therepast, the improvement comprising entrance means through which a coin is adapted to enter the chute laterally through said one wall at a point upstream of the detecting means, the entrance means comprising a passageway having an inclined reach extending laterally upwardly away from the chute at an inclination off vertical more than said one wall of the chute, an inlet for entry of coins into the passageway for travel down the inclined reach thereof toward the chute, and an outlet opening into the chute through said one side wall thereof at an elevation above the track therebelow and at a location upstream of the detecting means. The passageway is adapted to guide a coin exiting through the outlet laterally across the chute for impact against the other side wall of the chute thereby to deaden the motion of the coin and to deflect it down onto the track for rolling on edge down the chute without substantial bounce or flutter and with the coin in face-to-face engagement with said one wall of the chute for accurate detection by the detecting means as the coin rolls therepast. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
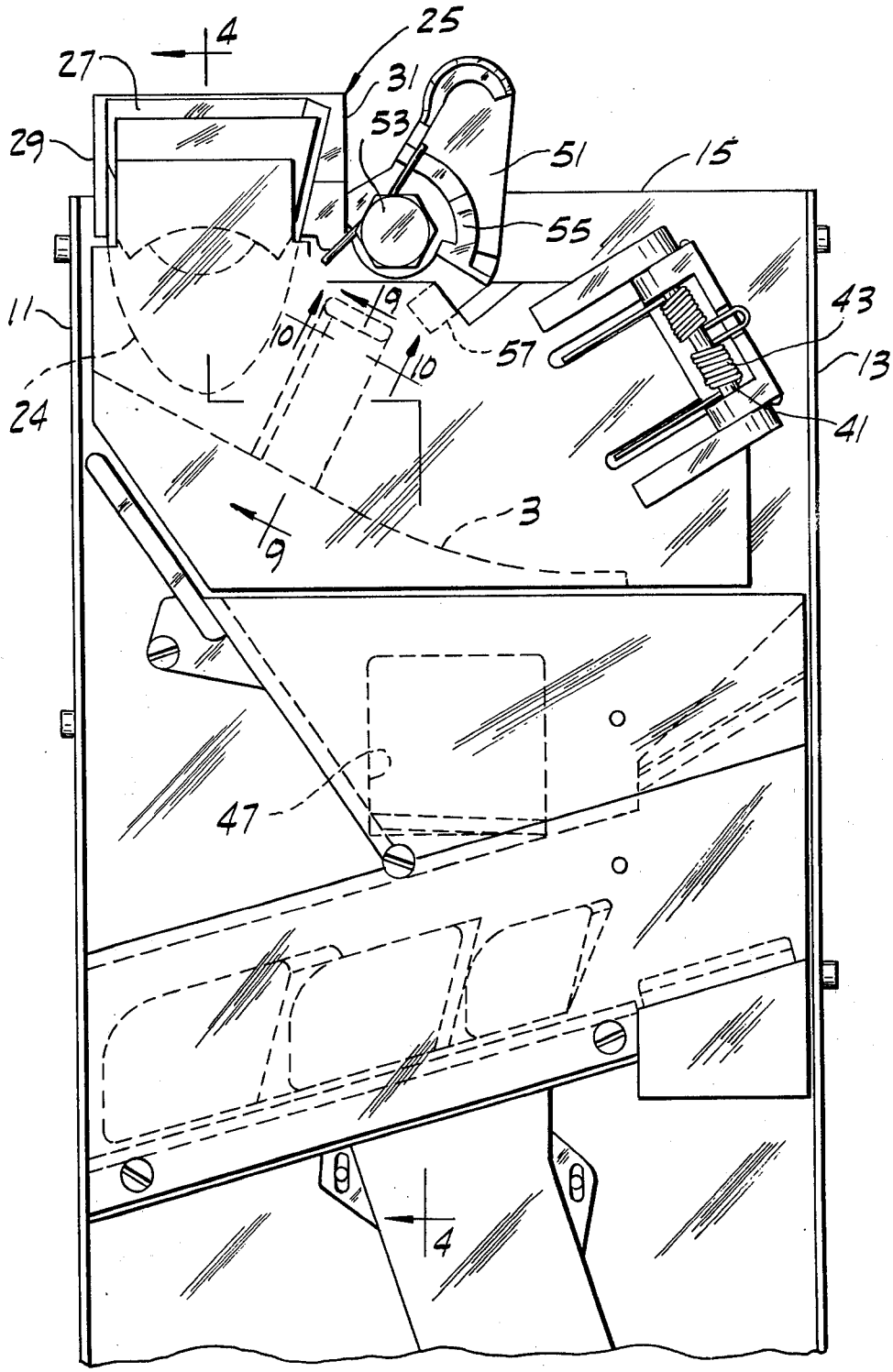
FIG. 1 is a view in front elevation of the upper part of coin apparatus of this invention.
Figure 2:
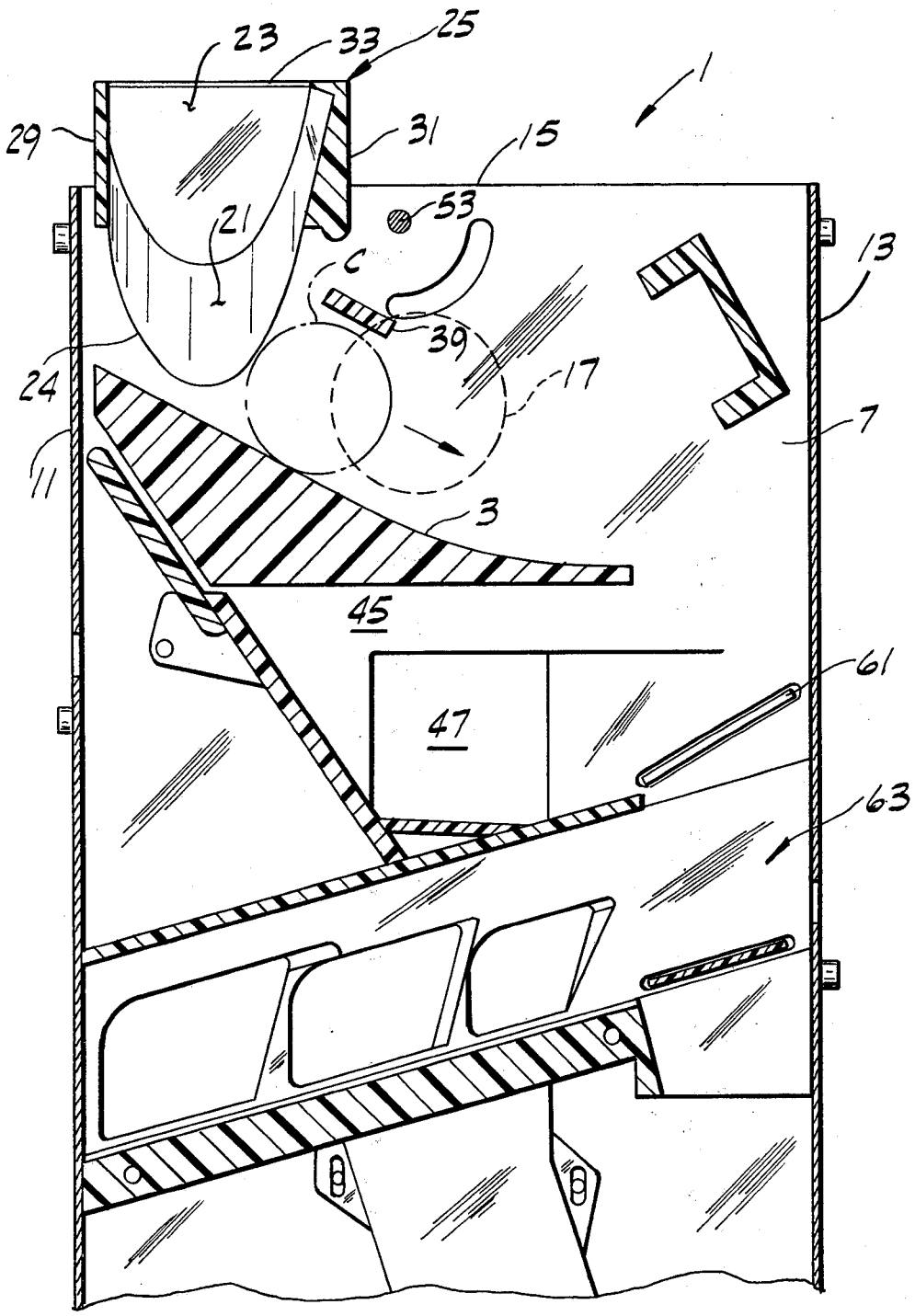
FIG. 2 is a view similar to FIG. 1 with parts removed to show interior details and with parts shown in section.
Figure 4:
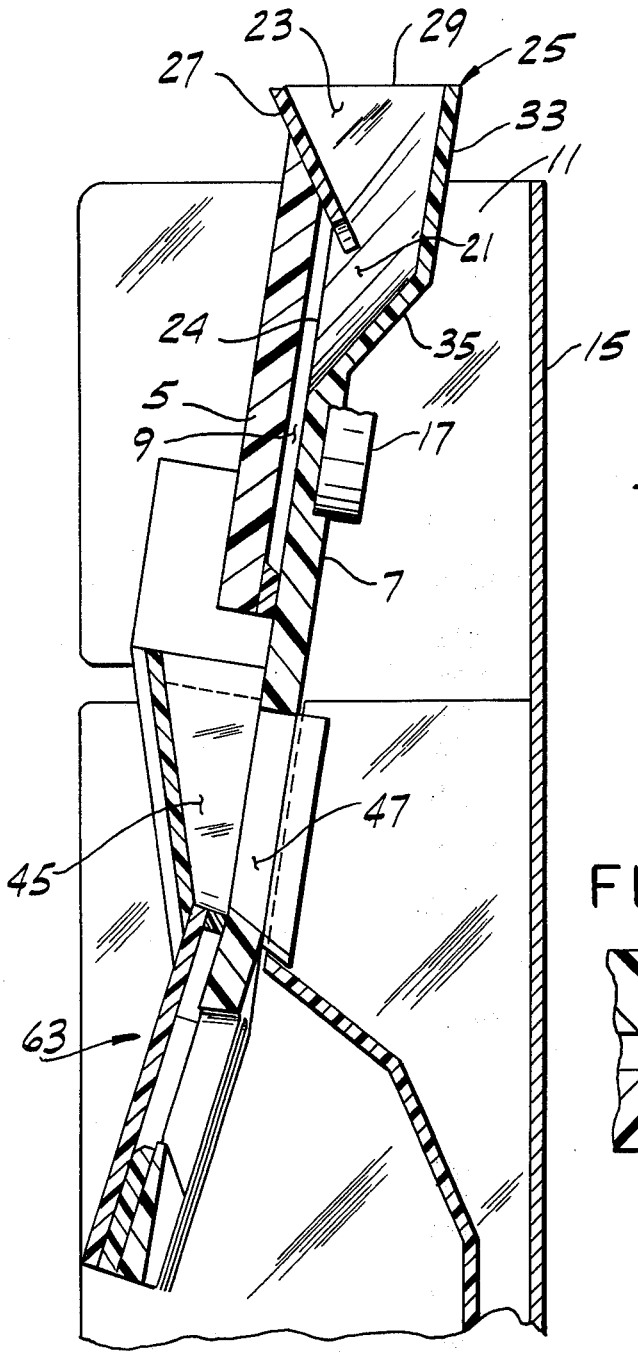
FIG. 4 is a vertical section generally on line 4—4 of FIG. 1.

Referring to the drawings, first more particularly to FIGS. 1, 2 and 4, coin apparatus incorporating the present invention is indicated in its entirety by the reference numeral 1. Acceptable coins C (and unacceptable items such as slugs and unacceptable coins) entering the mechanism roll on edge down a track formed by a rail member 3 inclined down from the left side of the apparatus toward the right side of the apparatus as viewed from the front. Front and rear walls or panels 5 and 7 at opposite sides of the rail member 3 form in conjunction with the rail member an inclined chute 9 in which coins and other circular items are confined for rolling down from left to right. The front panel 5 is preferably of a clear molded plastic, such as that sold under the trade designation "Lexan" by General Electric Co., and the rear panel 7 of a molded plastic such as that sold under the trade designation "Noryl" by the same company. The panels are generally parallel and spaced apart a distance not substantially greater than the thickness of the thickest coin to be handled. The rear panel 7 is fixed in position extending between left and right side walls 11 and 13 of a housing 15 and is inclined off vertical as appears in FIG. 4 in the direction toward the front of the apparatus from top to bottom, so that items roll down on the rail member 3 in face-to-face engagement with the rear panel 7.

Means indicated generally at 17 (see FIG. 2) is provided along the chute 9 for detecting whether an item traveling therein is an acceptable coin or an unacceptable item and, if it is an acceptable coin, detecting its denomination. The detecting means 17 may be of the abovestated type such as shown in U.S. Pat. Nos. 3,918,564, 3,952,851 and 3,966,034, for example, adapted on passage thereby of an item in chute 9 to transmit a signal indicative of the item being an unacceptable item or an acceptable coin, and if an acceptable coin, indicative of its denomination. The detecting means is mounted on the back face of the rear panel or wall 7 of chute 9 and an item rolling down the chute leans back on the panel 7 as it passes the detecting means so that each item rolls past it in the same plane for consistent detection. In this latter regard, it will be understood that it is important that items roll smoothly past the detecting means without bouncing on the track or fluttering from side to side with respect to the chute, since such motion impedes accurate detection of the item by the detecting means 17. It is also important that items, whatever their size or mass, roll past the detecting means at substantially the same speed.

Figure 9:
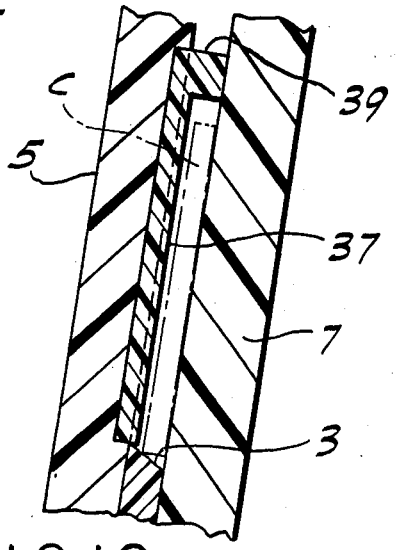
FIG. 9 is a section generally on line 9—9 of FIG. 1 showing a coin stabilizer.

Coins and other items are adapted to enter the chute 9 laterally through the rear panel 7 at a point upstream of the detecting means adjacent the left side of the apparatus (as viewed from the front) via an entrance comprising a passageway 21 having an inclined reach extending laterally (i.e., in front to rear direction with respect to the apparatus) upwardly away from the chute at an inclination off vertical more than the chute. For example, this reach of passageway 21 may be inclined 33° off the plane of the rear panel 7. The passageway 21 has an inlet 23 at the upper end of the inclined reach adapted for entry of coins into the passageway in a generally vertical plane laterally offset (rearwardly offset) from the chute, and an outlet 24 at the lower end of the inclined reach opening into the chute 9 through the rear panel 7 at an elevation above the rail member 3 therebelow and at a location upstream (to the left as viewed from the front of the apparatus) of detecting means 17. As will appear, a coin C entering through the inlet 23 is adapted to slide down the inclined reach of the passageway 21 and to be guided thereby laterally across the chute 9 for impact against the front panel 5. This serves to deaden the motion of the coin and to deflect it down onto the track 3 for smoothly rolling on edge down the track without substantial bounce or flutter and with the coin leaning against the rear panel 7 for accurate detection by the detecting means 17. To ensure that the coin rolls down the track generally in full face-to-face contact with the rear panel 7, the track is canted with respect to the walls 5, 7 of the chute 9 (see FIG. 9), being inclined downwardly from the front panel toward the rear panel at an angle off horizontal more than the angle at which the chute is inclined off vertical.

Figure 3:
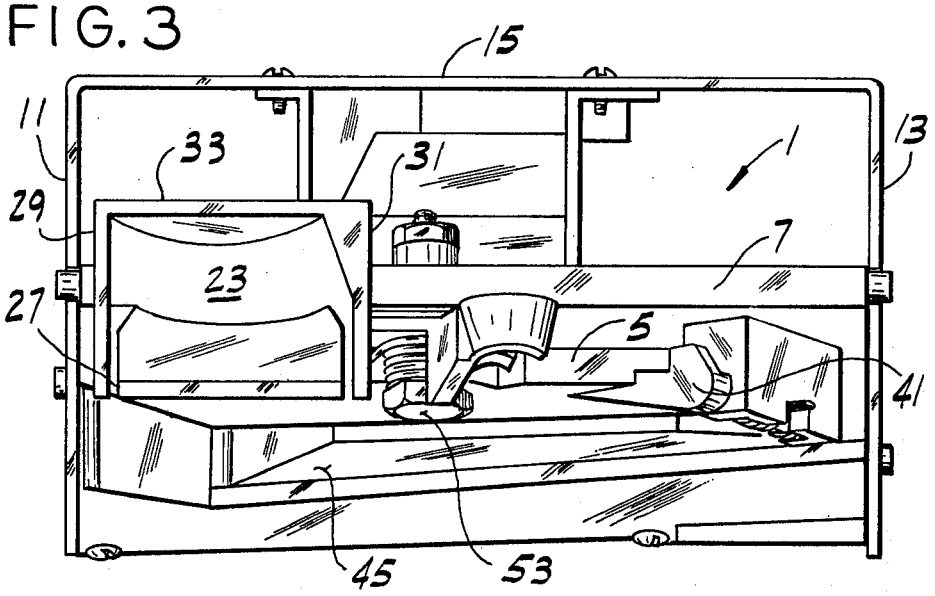
FIG. 3 is a top plan of FIG. 1.
Figure 5:
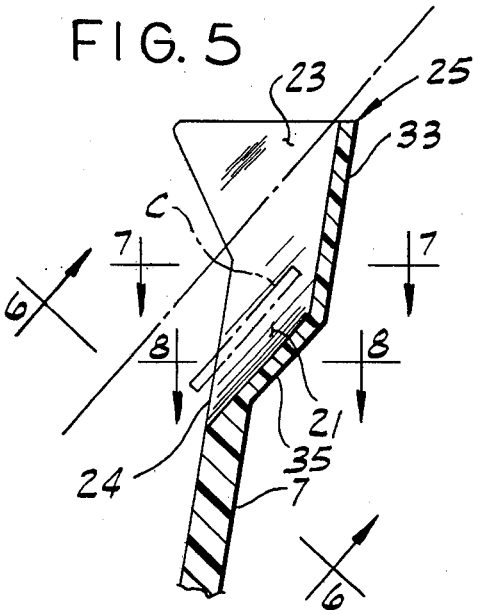
FIG. 5 is a portion of FIG. 4 showing entrance means of the present invention.
Figure 6:
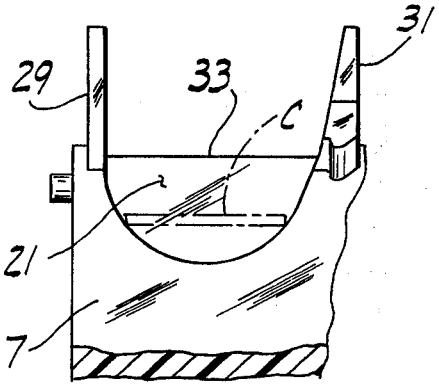
FIG. 6 is a section generally on line 6—6 of FIG. 5.
Figure 7:
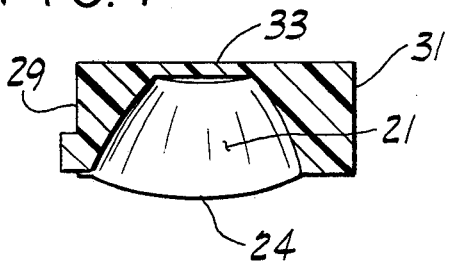
FIG. 7 is a horizontal section generally on line 7—7 of FIG. 5.
Figure 8:
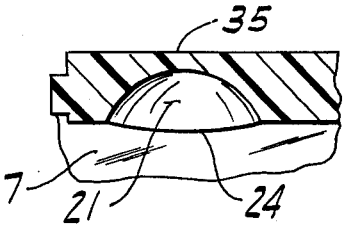
FIG. 8 is a horizontal section generally on line 8—8 of FIG. 5.

A channel-shaped entrance or inlet formation, generally designated 25, at the top left of the rear panel 7 and a tongue 27 at the top left of the front panel define passageway 21. As shown in FIGS. 3 and 4, the inlet formation is integrally formed (e.g., molded) with the rear panel 7 and has left and right side walls 29, 31, a rear wall 33 spaced rearwardly of and generally parallel to the plane of panel 7, sloping slightly forwardly from top to bottom with respect to the apparatus, and a bottom wall 35 which is inclined downwardly from the rear wall 33 to panel 7 at an angle corresponding to that of the inclined reach of passageway 21. The inside surfaces of the side and bottom walls of the inlet formation define the inclined reach of passageway 21.

The tongue 27, which is also preferably of a molded plastic such as that sold under the trade designation "Noryl" by General Electric Co., is secured (e.g., bonded) on the front panel 5 and forms in conjunction with the rear and side walls 29, 31 and 33 of the entrance formation 25, the inlet 23 of passageway 21. The tongue is inclined toward the rear of the apparatus from top to bottom to funnel coins down for entry into the inclined reach of passageway 21, the coins assuming a generally vertical orientation as they drop through the throat of the inlet between the bottom edge of the tongue 27 and the rear wall 33 of the inlet formation 25. On striking the bottom wall 35 of formation 25, the coins pivot clockwise (as viewed in FIG. 4) from a generally vertical plane into the inclined plane of the passageway. The bottom edge of the tongue 27 is upwardly arched to prevent jamming of the coins as they drop through the throat of the inlet 23 (see FIG. 1).

As shown in FIGS. 2 and 6–8, the inclined reach of passageway 21 is concave and is so sized and contoured that a coin is adapted to slide down the passageway toward the chute in an inclined plane with only the opposite edge portions of the coin in contact with surfaces of the passageway. As viewed from the front of the apparatus (FIG. 2), the passageway appears generally parabolic in shape. As viewed in transverse section (FIG. 6) it is rounded, having a radius of curvature preferably greater than that of the largest diameter coin the apparatus is designed to handle. For example, assuming the apparatus is capable of handling nickels, dimes, quarters and the new U.S. dollar, which has a diameter slightly greater than that of the quarter, the radius of curvature may be about 0.69 inches. A rounded configuration is desirable in that it provides for a smooth and consistent delivery of coins to the chute 9, this being due to the fact that opposite edge portions of the coins sliding down the inclined reach of passageway 21 are always in contact with surfaces of the passageway regardless of the size of the coin. Thus, acceptable coins and unacceptable items of all sizes capable of being handled by the coin apparatus are accurately guided down and out of the passageway and into the chute 9 along a single predetermined path. The fact that the inclined reach of the passageway is of rounded configuration is also advantageous in that the force of coins dropping through the inlet 23 onto the bottom wall 35 of the entrance formation 25 is more evenly distributed for better surface wear. This is particularly important where the surface of the passageway 21 is of plastic.

The outlet or mouth 24 of passageway 21 is dimensioned to be of sufficient height for permitting a coin sliding out of the passageway and impacting against the front panel 5 (i.e., the left wall of the chute 9 as viewed in FIG. 4) to clear the roof of the passageway as it pivots from the inclined plane of the passageway into the plane of the chute.

Travel of coins and other circular items through passageway 21 and their impact against the front panel 5 for deflection down onto the rail member 3, serves to deaden or retard the motion of the items so that they roll smoothly without substantial bounce or flutter and at substantially the same rate of speed down the chute while leaning back against the rear wall of the chute formed by panel 7. This enables the items to be accurately detected by detecting means 17.

As an added precaution against bounce or flutter of items rolling down the chute toward detecting means 17, stabilizing means comprising a stabilizer plate 37 is set flatwise into the front panel 7 along the track at a location downstream of outlet 25 and immediately upstream of the detecting means. As shown best in FIG. 9, the rear (right) face of this stabilizer plate 37 projects into the chute 9 and restricts the width thereof to a width only slightly greater than the thickness of the a coin sliding down and impacting against said other wall of the chute to swing up from said inclined plane into the plane of the chute.

8. In coin handling apparatus as set forth in claim 1, said inclined reach of passageway being inclined at an angle of about 33° off said one wall of the chute.

9. In coin handling apparatus as set forth in claim 1, the improvement further comprising a coin stabilizer along said track downstream of the outlet of the passageway but upstream of said detecting means for restricting the width of said chute to a width only slightly greater than the thickness of the thickest coin to be handled by said apparatus, a coin fluttering from side to side with respect to the chute as it rolls down the chute thus being adapted to be stabilized as it is channeled past the stabilizer for rolling down the track without flutter.

10. In coin handling apparatus as set forth in claim 9, said stabilizer having a portion spaced above the track a distance not substantially greater than the largest diameter coin to be handled by said apparatus, a coin bouncing down the track thus being adapted to be stabilized as it passes beneath said stabilizer portion for rolling on edge down the track without bounce.

11. In coin handling apparatus as set forth in claim 1, said track being canted with respect to the walls of the chute downwardly from said other wall toward said one wall for ensuring that coins entering the chute roll on edge down the track generally in full face-to-face contact with said one wall of the chute.

Figure 10:
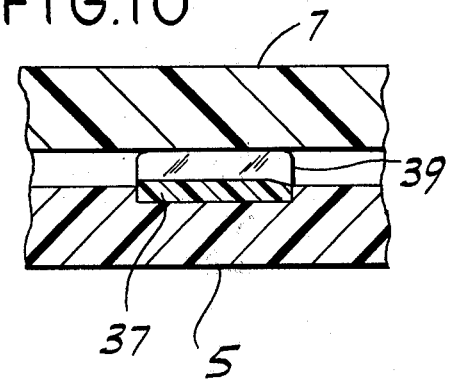
FIG. 10 is a section generally on line 10—10 of FIG. 1.

* * * * * thickest coin to be handled by the apparatus. Thus, if an item rolling on edge down the chute is fluttering from side to side with respect to the chute, it will be stabilized as it is channeled past the plate 37. The upstream edge of the plate is beveled to guide items therepast (see FIG. 10). The stabilizer plate has a portion or flange 39 along its upper edge projecting from the rear face of the plate toward the rear wall 7 of the chute and spaced above the rail member 3 a distance not substantially greater than the diameter of the largest diameter coin to be handled. This flange serves an antibounce function so that in the unusual event an item is bouncing down the track, it will be stabilized as it travels beneath the flange 39 of the stabilizer plate for rolling down the track without further bouncing.

The rail member 3 forming the track down which coins roll past the detecting means 17 is secured to the front panel 5 which is pivoted as indicated at 41 at its upper right hand corner for swinging movement toward and away from the rear panel 7. A spring 43 biases the front panel toward its closed position wherein the rail member engages the rear panel. The panels lie generally parallel to one another spaced the width of the rail member. As previously stated, this spacing is not substantially greater than the thickness of the thickest coin to be handled. The front panel 5 is adapted to be swung away from the rear panel 7 to remove the rail member from below a coin or other item which may be jammed in the chute 9 to clear the jam (i.e., for scavenging), the coin or other item then sliding down the rear paneling to the open top of a return chute 45, the rear wall of which is formed by the rear panel 7. The bottom of this return chute is inclined for directing items falling to the chute through an opening 47 in the rear panel 7 and, from there, to a conventional return system (not shown) for delivery of the items to a return cup, for example.

A scavenging mechanism comprising a scavenging lever 51 pinned at 53 to the rear panel 7 adjacent the entrance formation 25 is provided for camming the front panel away from the rear panel for scavenging. The lever 51, preferably of plastic, has an inclined camming surface 55 which is interengageable with a wear pad 57 mounted on the rear face of the front panel 5 for swinging the latter away from the rear panel when the lever is pivoted clockwise from the position shown in FIG. 1. The lever is spring-biased toward its FIG. 1 position in which it is removed from between the panels.

The way in which an item is handled after it rolls off the right (FIG. 2) end of rail member 3 and out of the chute 9 will depend on whether the detecting means 17 has signaled that the item is an acceptable coin or an unacceptable item. If the item is unacceptable, a solenoid-operated exit gate 61 extending forwardly through the rear panel 7 and inclined downwardly from right to left will guide the item into the left (open) side of the return chute 45 for passage to the above-mentioned return system. If the item is an acceptable coin, the exit gate 61 will be open, allowing the coin to drop to an accept system 63 not constituting part of the present invention.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In coin handling apparatus of the type having a track down which coins may roll on edge, walls at opposite sides of the track for confining the coin to rolling along the track, said track and walls forming a chute, the latter being inclined off vertical for coins to roll down the chute in face-to-face engagement with one of said walls, and means along said one wall of the chute for detecting a coin as it rolls therepast, the improvement comprising entrance means through which a coin is adapted to enter the chute laterally through said one side wall at a point upstream of said detecting means, said entrance means comprising a passageway having an inclined reach extending laterally upwardly away from the chute at an inclination off vertical more than said one wall of the chute, and an inlet for entry of coins into the passageway for travel down said inclined reach toward said chute, said passageway opening into the chute through said one side wall thereof at an elevation above the track therebelow and at a location upstream of said detecting means, said inclined reach having an inside concave surface opposed to and facing said other side wall of the chute, said concave surface being so sized and contoured that coins which the apparatus is to handle slide down said inclined reach of the passageway generally in a plane inclined off vertical more than said one wall of the chute with only opposite edge portions of the coin in contact with said concave surface, the coin proceeding down in said inclined plane and being directed by said inclined reach laterally across the chute for impact of its lower edge portion against the other side wall of the chute thereby to deaden the motion of the coin and to deflect it down onto the track for rolling on edge down the chute without substantial bounce or flutter and with the coin in face-to-face engagement with said one wall of the chute for accurate detection by said detecting means as the coin rolls therepast.

2. In coin handling apparatus as set forth in claim 1 said inclined reach of the passageway having a radius of curvature greater than that of the largest denomination coin the apparatus is designed to handle.

3. In coin handling apparatus as set forth in claim 2, said inlet being formed for entry of a coin into the passageway in a generally vertical plane laterally offset from the chute.

4. In coin handling apparatus as set forth in claim 3, said inlet and said inclined reach being formed by an entrance formation on said one side wall of the chute.

5. In coin handling apparatus as set forth in claim 4, said entrance formation having a pair of opposing side walls, a rear wall spaced from and generally parallel to said one wall of the chute, and a bottom wall inclined downwardly from said rear wall toward said one wall of the chute, the inside surfaces of said side and bottom walls of the entrance formation forming said inside concave surface of the inclined reach of the passageway.

6. In coin handling apparatus as set forth in claim 4, said one side wall of the chute and said entrance formation being integrally formed of molded plastic.

7. In coin handling apparatus as set forth in claim 1, said chute having a width not substantially greater than the thickness of the thickest coin to be handled by said apparatus, said passageway being formed for permitting